US006199412B1

(12) United States Patent
Kennedy

(10) Patent No.: US 6,199,412 B1
(45) Date of Patent: Mar. 13, 2001

(54) LOCKABLE TIE DOWN STRAP

(76) Inventor: Sam R. Kennedy, P.O. Box 394, Surfside, CA (US) 90743

( * ) Notice: Subject to any disclaimer, the term of this patent is extended or adjusted under 35 U.S.C. 154(b) by 0 days.

(21) Appl. No.: 09/312,368

(22) Filed: May 13, 1999

(51) Int. Cl.[7] ..... E05B 73/00
(52) U.S. Cl. ..... 70/18; 70/58; 70/164; 224/568
(58) Field of Search ..... 70/14, 15, 30, 70/49, 57, 58, 164; 24/167; 224/568

(56) References Cited

U.S. PATENT DOCUMENTS

| | | | | |
|---|---|---|---|---|
| D. 365,236 | | 12/1995 | Stockwell | D6/552 |
| 587,526 | * | 8/1897 | Holden . | |
| 590,613 | * | 9/1897 | Garrett . | |
| 700,158 | * | 5/1902 | Stoneman . | |
| 715,948 | | 12/1902 | Beveridge . | |
| 735,689 | * | 8/1903 | Adams . | |
| 3,592,028 | * | 7/1971 | La Monica | 70/57 |
| 3,831,976 | | 8/1974 | Iden, Sr. | 280/179 A |
| 3,875,771 | * | 4/1975 | Reisner | 70/18 |
| 4,340,376 | | 7/1982 | Williams | 70/58 X |
| 4,526,125 | | 7/1985 | Bain, Jr. | 70/18 X |
| 4,685,315 | | 8/1987 | Comolli | 70/68 |
| 4,712,394 | | 12/1987 | Bull | 70/18 |
| 4,860,408 | | 8/1989 | Johnson | 24/68 CD |
| 4,918,790 | | 4/1990 | Cirket et al. | 24/71 R |
| 4,938,040 | | 7/1990 | Humphreys, Jr. | 70/58 |
| 4,951,365 | | 8/1990 | Loyd | 24/68 CD |
| 5,095,722 | | 3/1992 | Chapmond et al. | 70/18 |
| 5,177,986 | * | 1/1993 | Jensen | 70/18 |
| 5,193,368 | | 3/1993 | Ling | 70/30 |
| 5,243,710 | | 9/1993 | Craycroft | 2/312 |
| 5,387,183 | | 2/1995 | Jones | 602/19 |
| 5,582,044 | | 12/1996 | Bolich | 70/58 |
| 5,582,046 | * | 12/1996 | Baumwoll et al. | 70/162 X |
| 5,692,403 | * | 12/1997 | Ling | 70/57 X |
| 5,706,680 | | 1/1998 | Wroble | 70/18 |

FOREIGN PATENT DOCUMENTS

| | | | | |
|---|---|---|---|---|
| 2725580 | * | 12/1977 | (DE) | 70/58 |
| 2725843 | * | 12/1977 | (DE) | 70/18 |
| 192777 | * | 2/1923 | (GB) | 70/18 |

* cited by examiner

*Primary Examiner*—Lloyd A. Gall
(74) *Attorney, Agent, or Firm*—James G. O'Neill

(57) ABSTRACT

A lockable tie down strap used to secure various loads to a variety of support surfaces, such as a vehicle, a boat, a pallet, a shelf, a tray, a cage, or the like. The lockable tie down strap has one loose end that is secured in a key-operated locking member to prevent theft, and is preferably constructed of a tubular webbing with steel cables running through the body of the webbing to prevent cutting of the strap, and thereby more securely hold a load by the strap. The strap may also be provided with loose ends having openings or a hook at the ends, for use with a roof rack or a wire cage to hold equipment or a flexible load in position.

9 Claims, 4 Drawing Sheets

LOCKABLE TIE DOWN STRAP

BACKGROUND OF THE INVENTION

1. Field of the Invention

This invention relates generally to tie down devices, and, more particularly, to an improved lockable, tie down strap for hard-to-lock down loads, having no locking passage or element therein.

2. Description of Related Art

When storing or transporting valuable items or loads in or on boats, pallets, racks, shelves, vehicles, or the like, the item or load is often secured in place by a bungie cord, rope, strap, or the like. In addition, if the item or load is left unattended over a periods time, some type of locking mechanism, such as a cable lock or padlock, is used in an attempt to lock the item or load and prevent theft. Items or loads held in racks mounted on the tops of vehicles, such as surfboards and the like, are particularly susceptible to theft and should utilize some type of easily used and available locking tie down device, to prevent theft.

Many prior art locking systems and tie down devices are known. However, these known devices are not cost effective, nor are they particularly effective in providing security from theft for substantially all types of valuable items or loads. For example, many valuable items or loads do not have an opening or holding portion through which a cable or padlock can pass to lock down such item or load. Therefore, if a cable or lock is used to restrain an item or load, the item or load may be easily removed or stolen by merely loosening or shifting the cable or lock. Therefore, specifically designed locking assemblies, which are only designed to work with special fittings or the like, must be used if particular equipment or loads are to be locked down. These specifically designed locking assemblies tend to be expensive and complicated, and limited in use.

For example, it can be difficult to effectively lock a canoe, inflatable raft, kayak, small boat, surfboard, water skis or windsurfing equipment and the like, to a roof rack of a vehicle, without using such complicated, expensive tie down systems or racks with built-in locking arrangements. The known locking systems for racks or other holding assemblies are often inconvenient and/or hard to use. Therefore, persons in a hurry, or who are not handy, tend to forego engaging such locking devices or systems, and merely loosely tie down valuable items or loads, such as water sports equipment. As a result, such items are often lost, stolen, or used without permission.

Examples of known prior art locking devices and tie down systems are shown in U.S. Pat. Nos. D365,236 to Stockwell, 715,948 to Beveridge, 3,831,976 to Iden, Sr., 4,340,376 to Williams, 4,526,125 to Bain, Jr., 4,685,315 to Comolli, 4,712,394 to Bull, 4,860,408 to Johnson, 4,918,790 to Cirket et al., 4,938,040 to Humphreys, Jr., 4,951,365 to Loyd, 5,095,722 to Chapmond et al., 5,193,368 to Ling, 5,387,183 to Jones, 5,243,710 to Craycroft, 5,582,044 to Bolich and 5,706,680 to Wroble. These prior art devices and locking systems use different types of straps, which may be secured by easily taken apart hook and loop systems, buckles, or the like. Some of these devices or systems may have locks inserted in openings therein. Additionally, these known prior art patents disclose specifically designed locking devices for surfboards, kayaks and the like, which are limited in use since they must pass through openings in the item to be protected, or clamped to a portion of the equipment, such as to a fin of a surfboard.

U.S. Pat. No. 4,685,315 to Comolli shows a strap lock to hold suitcases, bags or the like together. This strap includes a lock that is used to lock the strap after the strap is wrapped around a bag. The lock must be opened before the strap may be removed from the suitcase or bag. However, neither Comolli nor any of the above-mentioned prior art locking systems and/or tie downs are adaptable to be used to easily and quickly hold and lock various size items and loads to a vehicle, or other support system, to prevent theft. Furthermore, none of the known prior art suggests the provision of strengthening means in the tie down strap itself.

Therefore, there exists a need in the art for a lockable tie down strap, adapted to be used with substantially any load, and which includes reinforcing elements in the strap. Furthermore, there exists a need for a tie down strap having a high strength cam-type lockable holding buckle, attached to a reinforced strap, which is used to lock down loads and which may not be removed without destroying the high-strength lock and/or cutting the reinforced tie down straps.

SUMMARY OF THE INVENTION

Accordingly, it is a general object of the present invention to provide an improved and simplified lockable tie down strap. It is a particular object of the present invention to provide an improved lockable tie down strap having a reinforcing means within the strap. It is a still more particular object of the present invention to provide an improved lockable tie down strap, which includes a high-strength lock that is simple in construction and in use, but which provides an effective securing and locking means for securing a load to a supporting surface. It is yet another particular object of the present invention to provide an improved lockable tie down strap having a key-operated, high-strength locking system in a cam-operated buckle having means therein to hold and lock a loose end of the tie down strap in a position cinched around a load. And, it is still another particular object of the present invention to provide a method for strapping down and securing loads in a locked position on a supporting surface, such as a roof rack, a shelf, or the like.

These and other objects and advantages of the present invention are achieved by providing a lockable, tie down strap having a separate reinforcing means in the strap, together with a locking cam-operated buckle secured to the reinforced strap to lock down substantially any size or shaped load to substantially any supporting surface. The present invention also provides a method of tying down and locking a load to substantially any holding surface, by utilizing a reinforced nylon, polyester, polypropelene, and the like, tubular webbing and a steel, cam-lockable buckle.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DETAILED DESCRIPTION OF THE PREFERRED EMBODIMENTS

Figure 1:
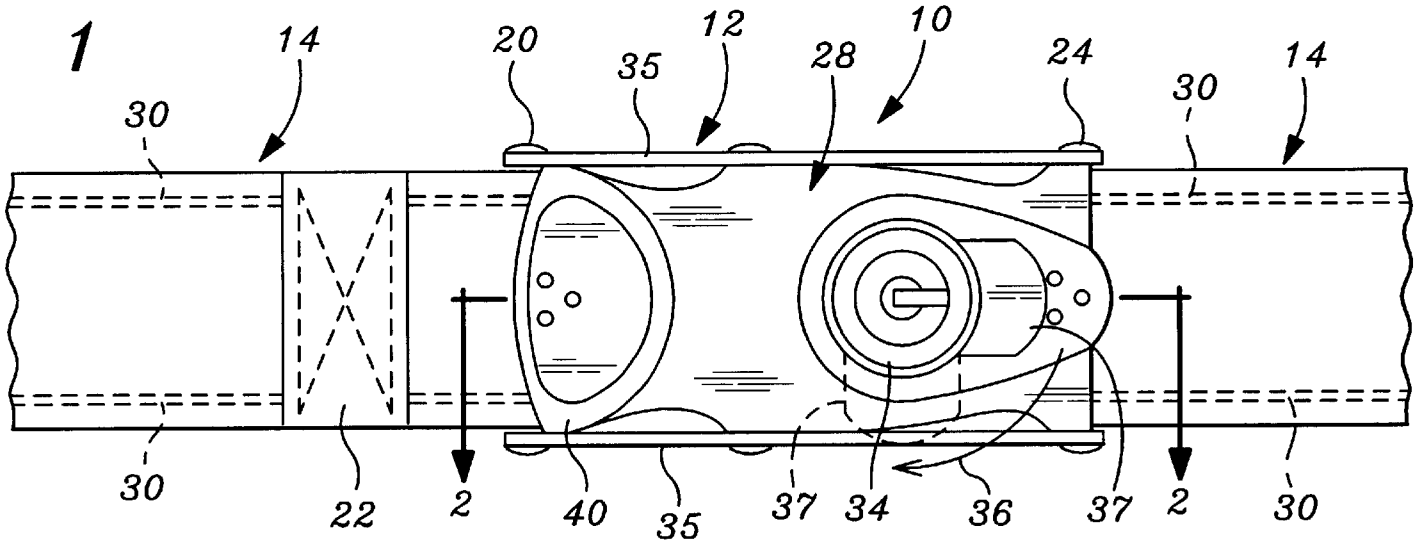
FIG. 1 is a partial top plan view of a tie down strap and cam-operated, lockable buckle of the present invention.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved, easy to assemble and use high strength, lockable tie down strap, generally indicated by the numeral 10.

Turning now to the drawings, there shown are various embodiments of a lockable tie down strap of the present invention, illustrating its use as a multi-purpose utility strap for securing various sized and shaped items or loads to a boat, pallet, shelf, vehicle, or the like. The locking tie down straps of the present invention may be used to save time in securing and locking in position, items including, but not limited to, canoes, kayaks, small boats, rafts, surfboards, water skis, wake boards, wind surfboards, backpacks, luggage, sleeping bags, duffel bags, coolers, tents, dinghies, small boats to davits, batteries, fuel tanks, water toys, boat covers, boat to trailer, lumber, pipe, windows, ladders, tool chests, crates, trunks, televisions, stereo equipment and computers.

Turning now to FIGS. 1–4 and 6, the lockable tie down strap 10 is shown as being comprised of a buckle 12 and an elongated strap 14 secured at first and second ends 16, 18 in the buckle 12. The first end 16 of the strap 14 is permanently held around a pin 20 at one end of the buckle 12, by securing the strap 14 together at 22, as by sewing or stitching. The second or loose end 18 of the strap 14 is inserted in and threaded around a second pin 24, at another or second end of the buckle 12. The end 18 is cinched or pulled to a desired tension or tightness around a load, and then locked in place in the buckle 12 by a gripping, locking, or serrated end 26 of a cam-operated element 28, as described more fully below. The buckle and its components are preferably made from a high strength material, such as steel, or the like. The tie down strap 14 is preferably reinforced by means 30, such as a flat metal wire braid, held in a plastic-coated strap. Or, preferably, the tie down strap 14 is made from a regular belting material, such as a textile, nylon, polyester, polypropelene, or the like, to make a tubular webbing, with a plurality of metal strands 30, made from steel, or the like, held or woven into the material, to add greater tensile strength. The reinforcing material 30 prevents cutting of the strap material 14 from the buckle 12 by a knife or other cutting implement, to greatly improve its theft resistance.

Figure 2:
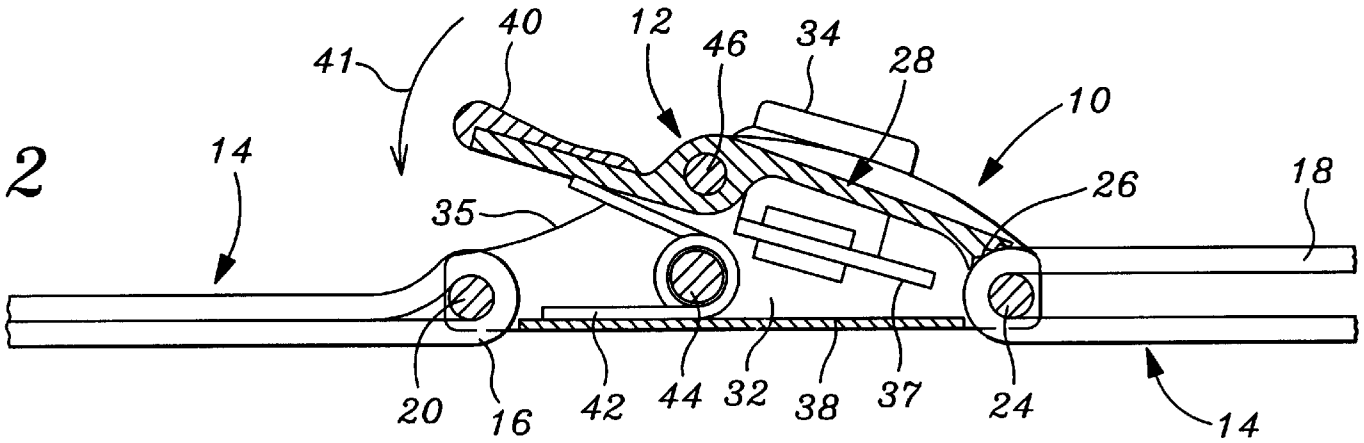
FIG. 2 is a cross sectional view taken along line 2—2 of FIG. 1.

As best shown in FIG. 2, the steel buckle 12 includes the reinforced strap 14 permanently coupled to the first end 20, with the other or loose end 18 inserted and releasably held around the pin 24. A key operated lock 34 is mounted in the cam-operated portion 28, between two side plates 35, and is movable to an open position, in the direction of the arrow 36 (see FIG. 1), when a key is inserted therein and turned, so as to turn a locking plate 37 to release it from a further locking plate held within a locking compartment 32, defined by the side plates 35 and a bottom plate 38. Upon being unlocked, the end 18 of strap 14 may be released from the serrated gripping or locking end 26 of the cam element 28 by pressing on a handle or tongue end 40 so as to rotate the cam element 28, in the direction of the arrow 41, against the bias of a spring 42, held in compartment 32 around a pin 44. The cam element 28 is rotatably mounted in the locking compartment 32, on a pivot 46.

Figure 3:
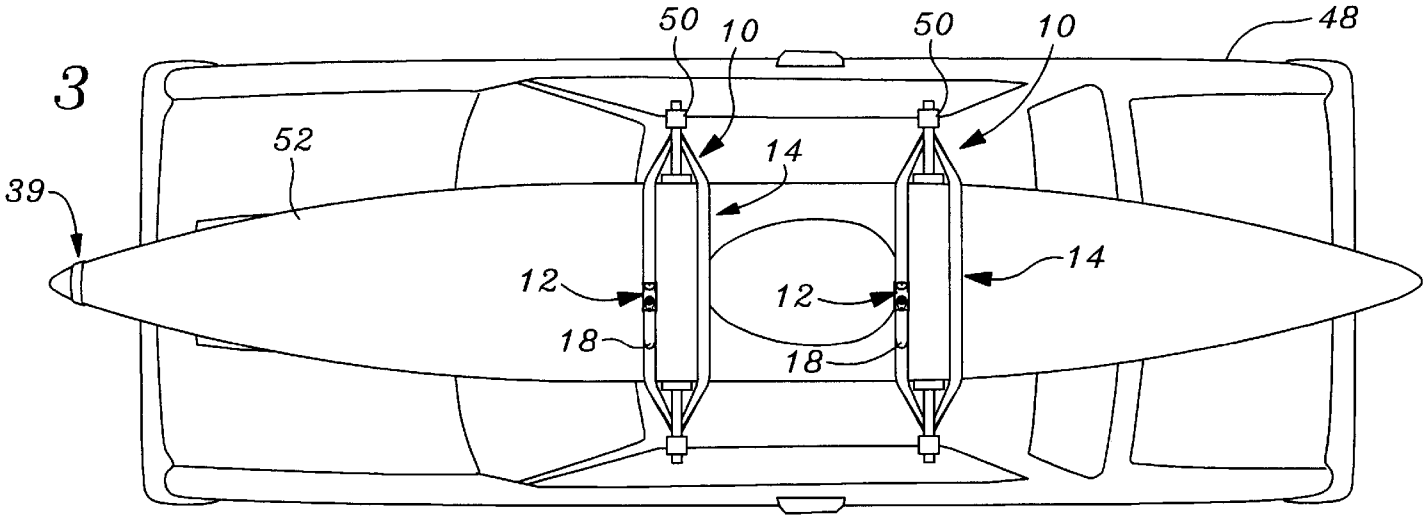
FIG. 3 is a top plan view of a vehicle, supporting a kayak thereon, and utilizing a plurality of lockable tie down straps of the present invention to secure the kayak to a roof rack of the vehicle.
Figure 4:
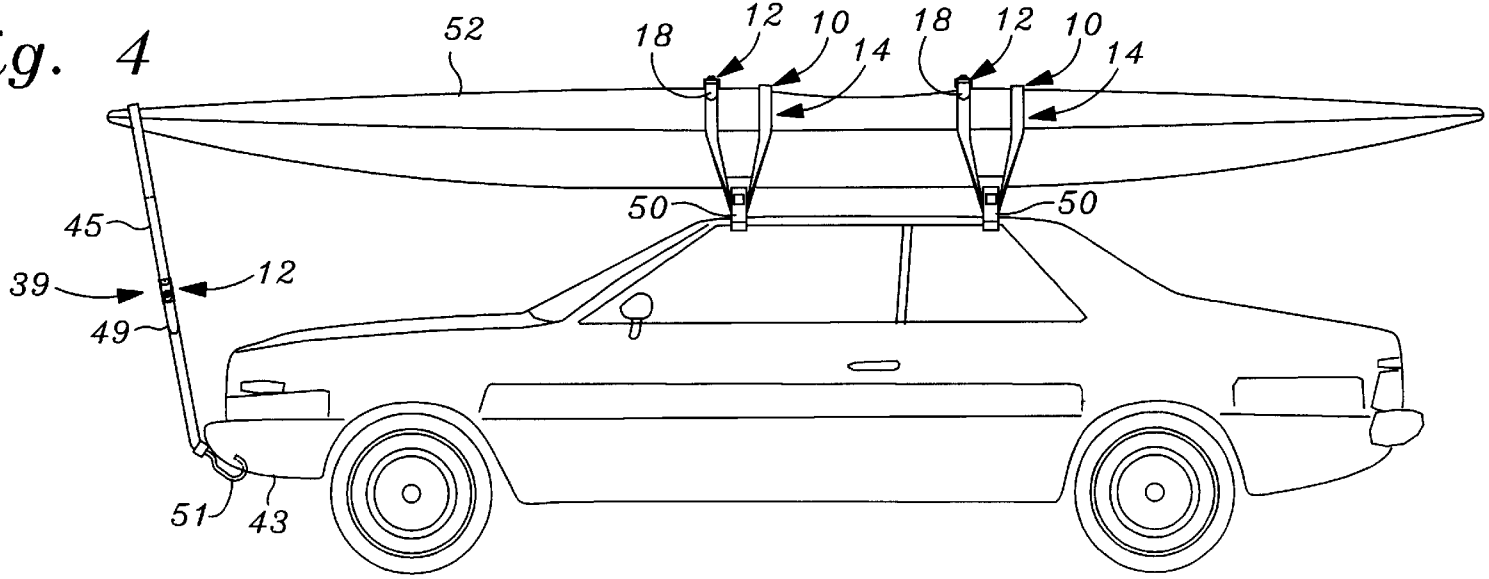
FIG. 4 is a side elevational view of FIG. 3.
Figure 6:
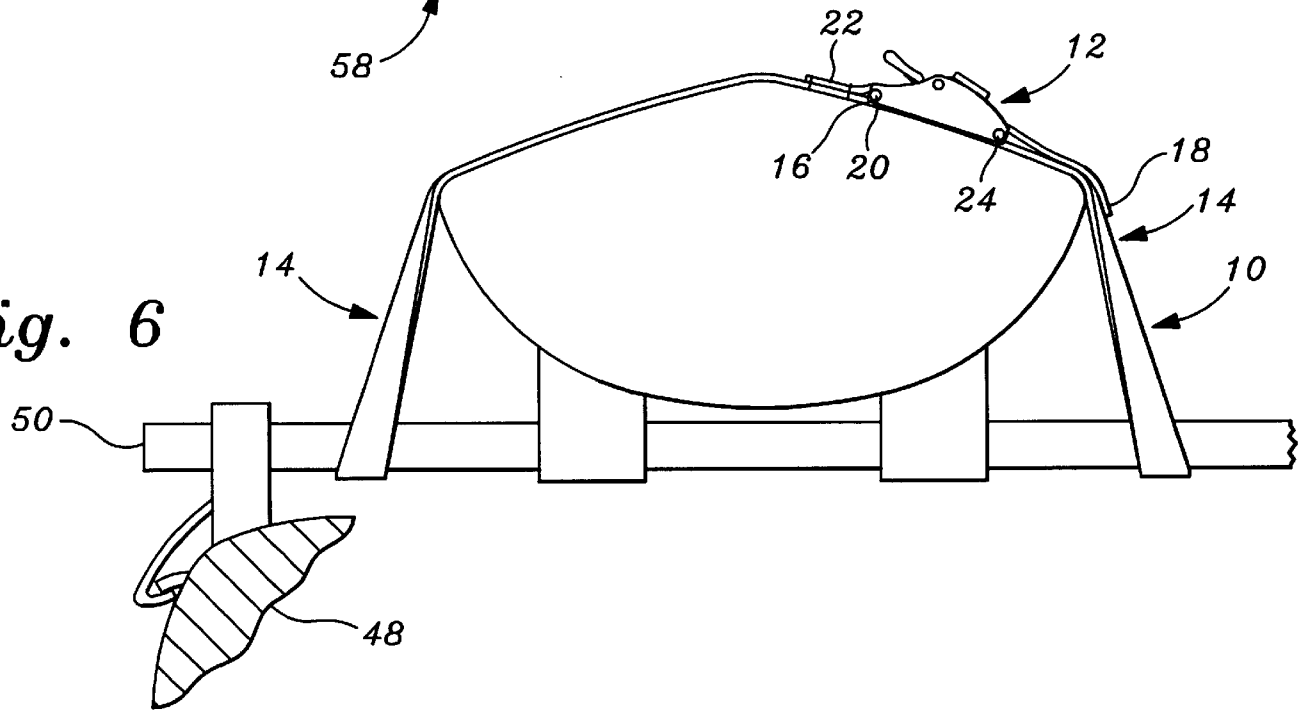
FIG. 6 is an enlarged, partial sectional side view of FIG. 4, showing one of the lockable tie down straps holding the kayak in position.

Turning now to FIGS. 3, 4 and 6, there shown is a vehicle 48 having roof racks 50 with a kayak 52 secured thereon by a pair of lockable tie down straps 10 of the present invention wrapped around the roof rack. A second embodiment of the lockable tie down strap is shown at 39, for use in locking the front of the kayak 52 to a bumper 43 of the vehicle 48. The lockable tie down strap 39 includes a first looped end strap 45, secured to a buckle 12 and hooked or looped over one end of the kayak 52. A second strap 47 is removably secured by a free end 49 in the lock 12, and a hook end 51, hooked on the bumper 43.

Each of the reinforced straps 14, used to tie down the kayak 52, have the buckles 12 and free ends 18 passed under opposite ends of each of the racks 50. The buckles 12 and free ends 18 are then pulled to the top of the kayak 52, with the free ends 18 further passing under the other end of each rack 50, on the opposite side of the kayak. The free ends 18 are then brought back to the top of the kayak where the loose ends 18 are inserted into the buckles 12. The buckles 12 are locked by their key-operated locks 34, after the loose ends 18 have been inserted and pulled taught where they are securely held in position by cooperating ends 26 of cam elements 28.

Figure 5:
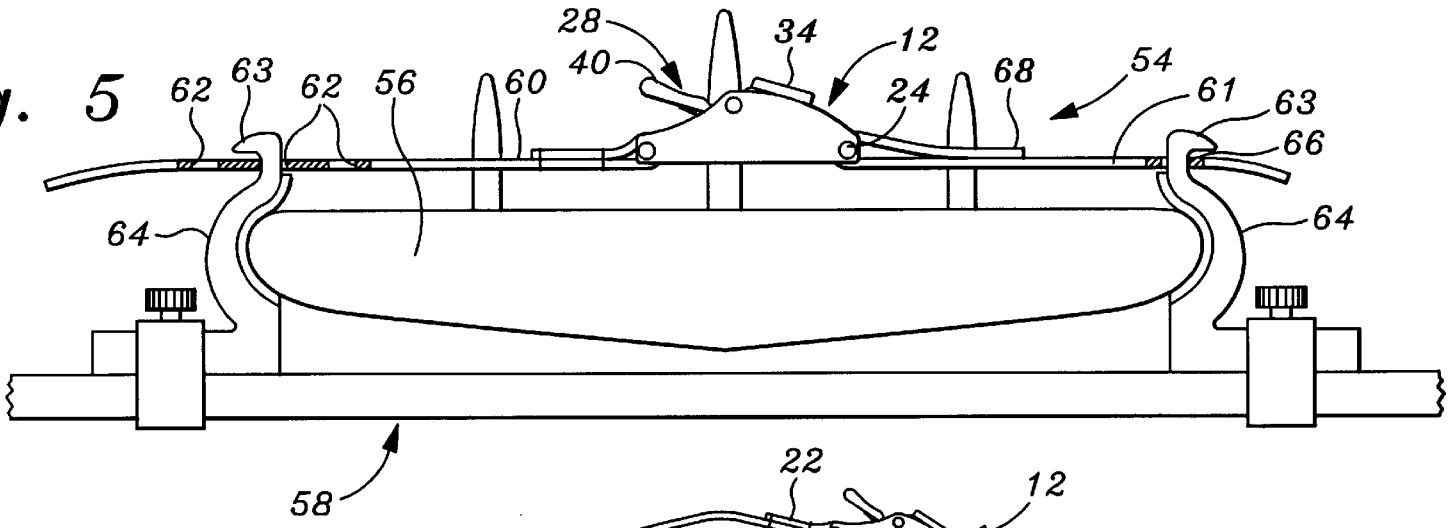
FIG. 5 is a schematic cross-sectional representation of a surfboard secured to an adjustable roof rack, by a third embodiment of a lockable tie down strap of the present invention.

Turning now to FIG. 5, there shown is a third embodiment of the lockable tie down strap of the present invention, generally indicated by the numeral 54. In this embodiment, the tie down 54 is shown being used to lock a surfboard 56 in a specially designed locking roof rack 58, of a type well known to those skilled in the art. The locking tie down strap 54 is comprised of two separate straps 60 and 61. The first strap 60 is secured to pin 20 in lock 12, in the same manner as described above with regard to the first end of the strap 14. The outer end of the strap 60, away from the buckle 12, includes a plurality of openings 62 formed therein, similar to the holes formed in a belt worn around the waist of an individual. One of these openings 62 is inserted and held in a holder, such as a locking end 63 of a first slidable element 64 mounted on the rack 58. The second strap 61, includes an exterior end, having at least one opening 66 therein. This opening 66 is placed over a further holder or locking end 63 of a second movable or slidable end 64 of the roof rack 58. An inner or loose end 68 of the second strap 61 is inserted around pin 24 in buckle 12, pulled to a tight position, where it is held by end 26, and the tie down strap 54 then locked in place by locking the locking member 34 in buckle 12, as discussed above. It is to be understood that at least two lockable tie down straps 54 will be used to lock a surfboard, or the like, in place.

Figure 7:
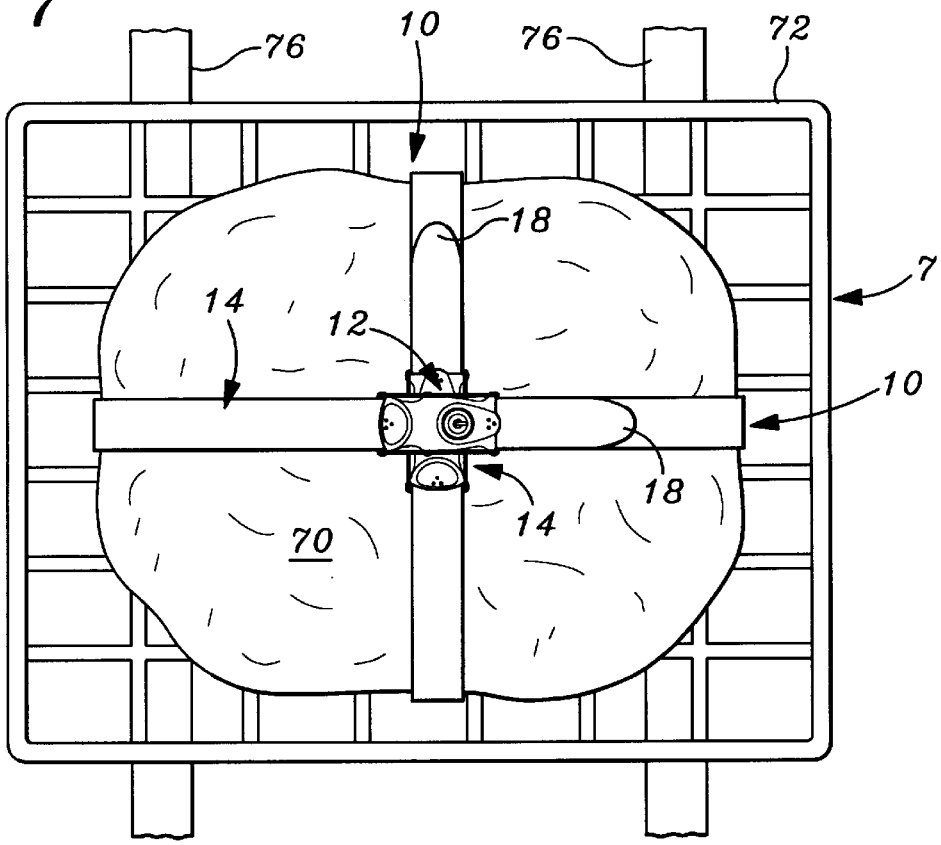
FIG. 7 is a top plan view of a cargo tray, having a load, such as a sports bag, held therein and secured in position by a pair of lockable tie down straps of the present invention, inserted through the tray and around the tray supporting elements.
Figure 8:
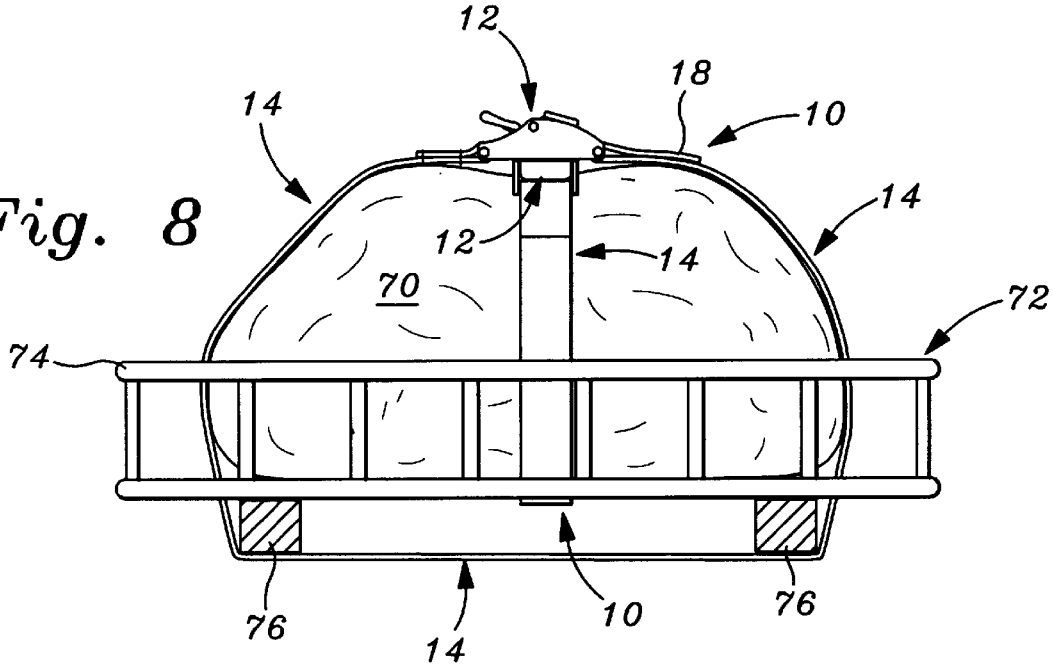
FIG. 8 is a front elevational view of FIG. 7.

Referring now to FIGS. 7 and 8, there shown is a pair of lockable tie down straps 10 of the present invention used to secured a flexible load 70, such as a duffel or sports bags, to an open carrying rack or pallet 72. The rack or pallet 72 includes an open wire cage 74 and a pair of supporting members 76, such as vehicle roof racks or pallet supports. As best shown in FIG. 8, the reinforced straps 14 are wrapped around the load 70, through the wire cage 74, with one of the straps passing around both supporting members 76, and the other strap wrapped around the bottom of the wire cage. Both straps are then wrapped around the load 70, with the loose ends 18 inserted around pins 24, and cinched or tightened to the desired position, so as to hold the load 70 firmly in place. Each buckle 12 is then locked, as described above, so as to keep the reinforced straps 14 tightly cinched around the load 70, and, therefore, maintain the load 70 locked to the rack/pallet 72.

The lockable tie down straps 10, 39, 54 of the present invention solve the long-standing problem of securing various items or loads on vehicles, or the like, in a simple and secure manner, by utilizing one or more lockable tie down straps, which tie down straps are easily attached to and/or removed from around substantially any size or shape load. These lockable tie down straps are versatile, and save time and expense in safely securing equipment, or other loads, to vehicle racks, pallets, shelves, or the like.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A lockable tie down system for a load, comprising:

at least one strap made from a tubular webbing material having reinforcing means held therein;

the at least one strap having a loose end and a fixed end;

a buckle having a key-operated lock with a locking compartment fixedly secured to the fixed end of the at least one strap for releasably holding the loose end of the at least one strap in the locking compartment;

the key-operated lock being mounted on a cam lever rotatably mounted in the locking compartment and having a locking end that engages with the loose end of the at least one strap when the loose end is inserted into the locking compartment, said cam lever including an end which is manually depressible to release the loose end, and a pivot located between the two ends;

a biasing means held in the buckle cooperating with the cam lever so as to normally bias the cam lever to a locked position; and the reinforcing means being comprised of at least two metal strands held in the tubular webbing material to prevent cutting of the at least one strap.

2. The lockable tie down system of claim 1 wherein the at least two metal strands are steel.

3. The lockable tie down system of claim 1 wherein there are two straps, with a first of the two straps having a fixed end secured in the buckle and a second end having a first securing means thereon; and a second of the two straps having a loose end cooperating with the buckle and an outer end having a second securing means thereon.

4. The lockable tie down system of claim 3 wherein the first securing means is an opening adjacent the second end, and the second securing means is an opening adjacent the outer end.

5. The lockable tie down system of claim 4 wherein there are two straps having at least two steel strands held in the tubular webbing.

6. A combination lockable tie down system and a vehicle roof rack, comprising:

a vehicle roof rack adapted to be secured to a top of a vehicle;

at least one reinforced strap adapted to pass around the vehicle roof rack and a load held in the vehicle roof rack;

the at least one reinforced strap having a fixed end and a loose end;

a steel buckle having a key-operated lock with a steel locking compartment;

the fixed end secured within the steel locking compartment at a first end of the buckle, the loose end inserted in a second end of the steel locking compartment;

the key-operated lock including a cam lever rotatably held in the steel locking compartment and having a serrated end that cooperates with the loose end inserted in the second end of the steel locking compartment to lock the loose end within the buckle, upon locking of the key-operated lock, a manually depressible end on the cam lever to release the serrated end, and a pivot located between the two ends;

a biasing means held in the steel locking compartment and cooperating with the cam lever so as to normally bias the cam lever to a locked position; and the at least one reinforced strap including a tubular webbing material having at least two steel reinforcing strands held therein to prevent cutting of the at least one reinforced strap.

7. The combination lockable tie down system and vehicle roof rack of claim 6 wherein the tubular webbing material is selected from the group of nylon, polyester and polypropelene.

8. The combination lockable tie down system and vehicle roof rack of claim 7 wherein there are two straps, with a first of the two straps having a fixed end secured in the buckle and a second end having a first securing means thereon; and a second of the two straps having a loose end cooperating with the buckle and an outer end having a second securing means thereon.

9. The combination lockable tie down system and vehicle roof rack of claim 8 wherein the first securing means is an opening adjacent the second end, and the second securing means is an opening adjacent the outer end.

* * * * *